United States Patent [19]

Adrian

[11] 4,182,402

[45] Jan. 8, 1980

[54] ROTARY REGENERATIVE AIR HEATER

[75] Inventor: Fritz Adrian, Ratingen, Fed. Rep. of Germany

[73] Assignee: Balcke-Durr Aktiengesellschaft, Ratingen, Fed. Rep. of Germany

[21] Appl. No.: 851,356

[22] Filed: Nov. 14, 1977

[30] Foreign Application Priority Data

Nov. 19, 1976 [DE] Fed. Rep. of Germany ..... 2652594

[51] Int. Cl.[2] ..... F28D 17/00

[52] U.S. Cl. ..... 165/10; 165/5

[58] Field of Search ..... 165/4, 10, 8, 5

[56] References Cited

U.S. PATENT DOCUMENTS 3,416,596 12/1968 Oldehaver ..... 165/10

3,756,310 9/1973 Becker ..... 165/10 X 3,874,442 4/1975 Johnsson ..... 165/10

FOREIGN PATENT DOCUMENTS 750303 6/1956 United Kingdom ..... 165/10

*Primary Examiner*—Albert W. Davis, Jr.

*Attorney, Agent, or Firm*—Joseph A. Geiger

[57] ABSTRACT

In a rotary regenerative air heater, an improved annular heat exchanger stack composed of several layers of heater lamellae packages and grate-like guide screen layers arranged on both ends of each lamellae package. The guide screen layers guide the flows of flue gas and air between stack layers and also serve to hold together the lamellae of each lamellae package with the aid of connecting tie rods.

4 Claims, 4 Drawing Figures

Fig. 3 [PRIOR ART]
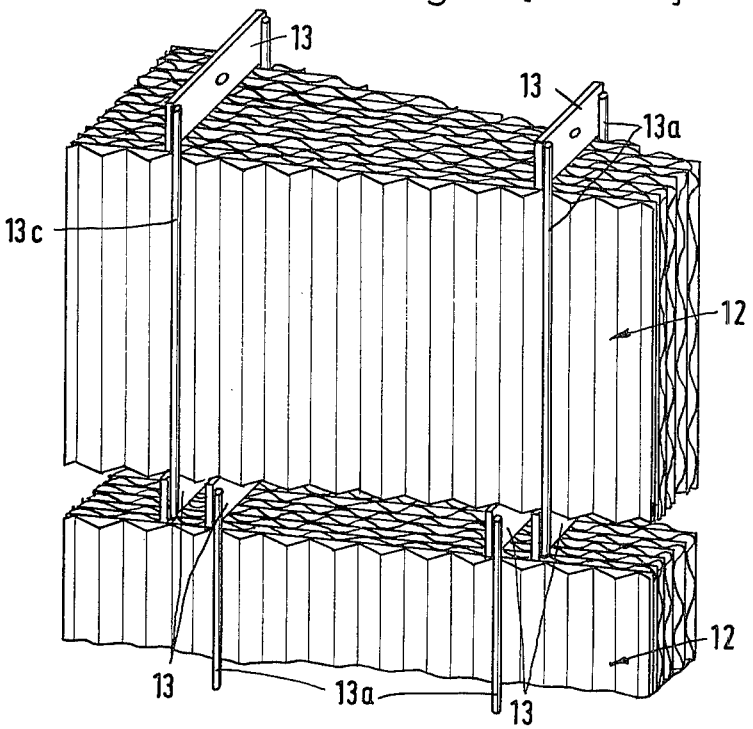
Fig. 4
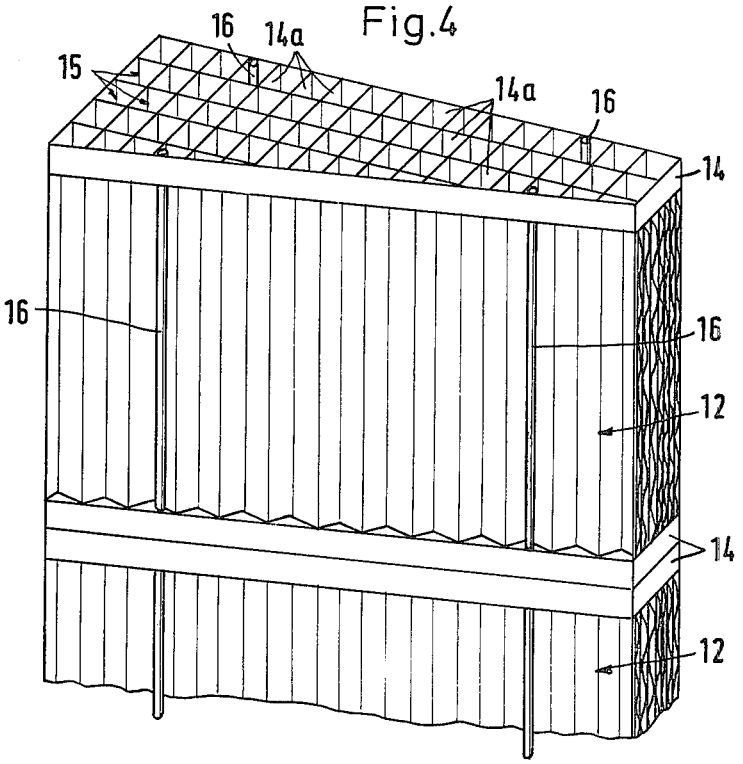

ROTARY REGENERATIVE AIR HEATER

BACKGROUND OF THE INVENTION

1. Field of the Invention

The present invention relates to heat exchanger devices, and, more particularly, to a rotary regenerative air heater or economizer which is mounted coaxially inside a flue duct, having a stack of heater lamellae packages which are alternatingly in contact with the hot flue gas and with the counter-flowing cold air which is to be heated.

2. Description of the Prior Art

Rotary regenerative air heaters which are arranged coaxially inside a flue duct are known from the prior art. They consist generally of a cylindrical stack of heater lamellae packages occupying the cross section of an enlarged length portion of the flue duct, so that the flue gasses have to pass axially through the lamellae packages. On the two axial sides of this heat exchanger stack are arranged air hoods which cover axially aligned, sector-shaped portions of the heat exchanger stack. A coaxially extending air duct supplies air through one air hood, removing it through the other.

A rotational relative motion between the cylindrical heat exchanger stack and the sector-shaped air ducts is obtained by either rotating the heat exchanger stack between stationary air ducts, or by rotating the two air ducts over the axial intake and outlet faces of a stationary heat exchanger stack. In both cases, the rotational relative motion results in alternating flows of hot flue gas and counter-flowing cold air through the lamellae packages, thereby transferring heat from the exiting flue gas to the incoming air. For average heat load conditions, the heater lamellae packages are composed of non-alloyed undulated sheet metal panels. For conditions of high heat load, these panels may be fabricated of non-scaling alloys. Air heater elements which operate at temperatures near the dew point may have enamelled heater lamellae.

It is also known from the prior art to be advantageous, from a point of view of fabrication costs and ease of assembly, to construct the heat exchanger stack of a succession of heat exchanger layers which consist of adjoining heater lamellae packages. This type of layered construction makes it possible to utilize different materials for different layers of heater lamellae packages, depending on whether they are on the hot or cold side of the heat exchanger stack. On the hot side, it may be necessary to use non-scaling sheet metal; on the cold side, it may be necessary to use sheet metal panels which are protected against corrosion.

It is further known to equip this type of rotary regenerative air heater with so-called soot blowing device, for the purpose of removing from the heater lamellae packages any soot and ash particles that may have been deposited by the passing flue gas. Such a soot blowing device normally operates with steam or compressed air, sweeping over the end faces of the heat exchanger stack in such a way that its blow jets move over the entire surface of the heat exchanger, once during each blowing cycle. A problem related to this type of soot blowing device is that the intensity of the blowing action must be kept within limits, in order to avoid erosion damage or vibration in the undulated sheet metal panels of the heater lamellae packages. On the other hand, these blow jets must be strong enough to pass through the successive layers of the heat exchanger stack at a speed which dislodges and removes the soot and ash deposits.

It is further known to operate the soot blowing device in such a way that it initially produces a counter-flow to the flue gas, whereupon it is reversed to the same direction as the flue gas, so that the loosened particles can be carried away by the exiting flue gas. However, there are certain limitations to this soot blowing approach: It can be used successfully only when the total height of the multi-layer heater stack is kept within certain design limits. If they are exceeded, in terms of the size of the heater exchanger stack and/or in terms of the number of layers which make up the complete stack, then it may happen that the deposits, instead of being removed, are compressed, especially in those heater lamellae packages which make up the middle layers of the stack. The result is a progressive clogging of the heat exchanger necessitating a shutdown of the entire boiler installation, to allow for the purging of the heater lamellae packages of the air heater with a high-pressure water jet.

SUMMARY OF THE INVENTION

It is the primary objective of the present invention to devise an improved rotary regenerative air heater of the type described above which facilitates the cleaning of the heater lamellae packages with a soot blowing device, especially in connection with a heat exchanger stack with multiple layers of lamellae packages.

The present invention proposes to attain this objective by suggesting an improved heat exchanger construction in which honeycomb-type screen panels are interposed between successive layers of lamellae packages, the screen panels serving as mounting means for the lamellae packages and as flow guides between the layers of the heat exchanger stack.

It has been found that the suggested heat exchanger construction with intermediate guide screen panels greatly improves the effectiveness of the blow jets of the soot blowing device. Where, previously, the flow of the soot blowing jets had to traverse a gap between adjacent layers of heater lamellae packages, this gap, necessary for the support and positioning of the heater lamellae packages, is now bridged by a guide screen panel. The air jets are no longer splattered, as previously, just before they enter the next layer of heater lamellae packages. The result is a conservation of jet energy, thereby increasing the number of successive layers which can be effectively blow-cleaned in this manner.

The suggested novel screen panels, in addition to serving as flow guides, also fulfill the function of mounting and positioning means for the heater lamellae packages, thereby taking the place of the flat-iron mounting brackets which had previously been necessary between the stack layers.

The proposed novel guide screen panels, while thus making it possible to build larger heat exchanger stacks, also improve the operating efficiency of the regenerative heater itself, by reducing the flow turbulence between heat exchanger layers. The air guide passages of the screen panels, while thus eliminating turbulence and transverse flow between the stack layers, especially at the borderline between the flue-gas-impinged heater lamellae packages and the air-impinged heater lamallae packages, nevertheless permit a certain flow equalization between the flow passages of successive heater lamellae packages. Lastly, the guide screen panels themselves transfer a certain amount of heat from the flue gas to the incoming air, thereby increasing the effective surface area of the heat exchanger. In sum, the suggested improvements in heat exchanger construction, while extending the dimensional limitations of a rotary regenerative air heater, also raise its operating efficiency, both from a fluidic standpoint and from a thermal standpoint.

In a preferred embodiment of the invention, the honeycomb-type guide screen panels are grate-like structures composed of intersecting strips of sheet metal, thereby forming rectangular guide passages. The simplicity of design reflects itself not only in moderate fabrication costs, it also lends itself readily for the adaptation of the overall dimensions of the screen panels to various cross-sectional shapes of the heater lamellae packages.

BRIEF DESCRIPTION OF THE DRAWINGS

Further special features and advantages of the invention will become apparent from the description following below, when taken together with the accompanying drawings which illustrate, by way of example, a preferred embodiment of the invention, represented in the various figures as follows:

FIG. 3 is an enlarged perspective representation of two typical prior art heater lamellae packages, forming part of a known heat exchanger stack; and FIG. 4 shows an embodiment of the present invention, as applied to the heater lamellae packages of FIG. 3, for use in a rotary regenerative air heater.

DESCRIPTION OF THE PREFERRED EMBODIMENT

Figure 1:
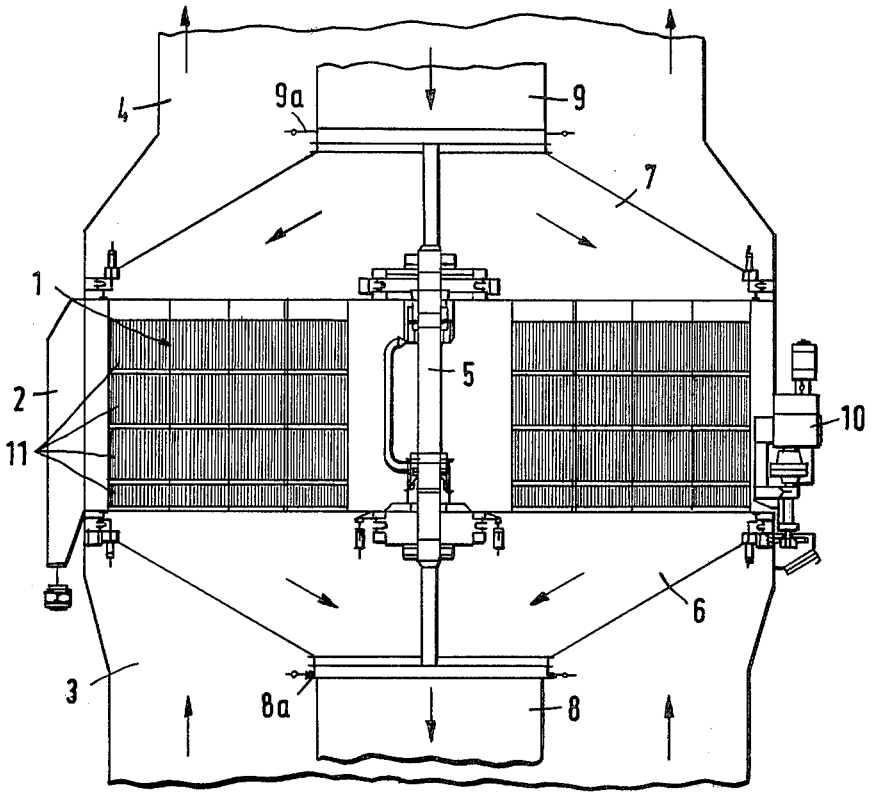
FIG. 1 shows, in a somewhat schematic longitudinal cross section, a rotary regenerative air heater embodying the present invention.
Figure 2:
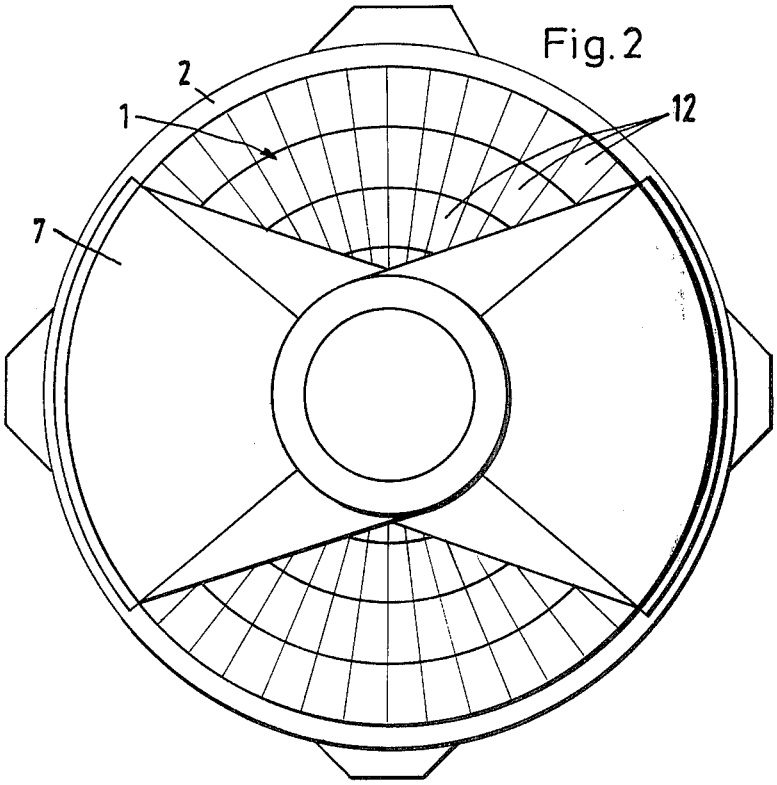
FIG. 2 shows the air heater of FIG. 1 in a plan view.

Referring to FIGS. 1 and 2 of the drawing, there is shown a rotary regenerative air heater, or economizer, exemplifying a preferred application of the present invention. The air heater, of which FIG. 1 is an axial cross section, consists of a heat exchanger stack 1 of annular shape, with cylindrical inner and outer peripheries. The heat exchanger stack 1 is fixedly mounted inside a tubular heater casing 2 which forms an enlarged length portion of a flue duct. The latter may form a part of the combustion unit of a boiler installation or the like. Appropriate lower and upper throat portions 3 and 4, respectively, form entry and exit transitions between the flue duct and the larger heater casing 2.

The heat exchanger stack 1 and the surrounding heater casing 2 define a longitudinal heater axis. In this axis, which is vertical in the device of FIG. 1, is arranged an arbor 5 with arbor portions protruding downwardly and upwardly from the heat exchanger stack 1. The protruding portions of the arbor 5 carry a lower rotary hood 6 and an upper rotary hood 7 which are interconnected for simultaneous rotation about the heater axis. The axially distal extremitites of the two rotary hoods 6 and 7 lead to a central air duct of which only the lower and upper connecting portions 8 and 9 are shown. The air duct itselt extends coaxially inside the flue duct. The lower and upper connecting portions 8 and 9 of the air duct are fixedly mounted inside the lower and upper throat portions 3 and 4 of the heater casing 2, leading into the lower and upper rotary hoods 6 and 7 by means of appropriate rotary seals 8*a* and 9*b*, respectively.

As can be seen in FIG. 2, where the upper rotary hood 7 is shown as seen from above, the two hoods 6 and 7 do not extend over the entire flow cross section of the heat exchanger stack 1, covering only a double-sector-shaped portion of the latter. The two rotary hoods 6 and 7 are driven by means of a hood drive 10 which includes an electric motor, a reduction gear, and a drive pinion. The latter engages a toothed profile on the periphery of the lower rotary hood 6. Suitable seals on the arcuate outer portions of the two rotary hoods cooperate with the inner wall of the heater casing 2, while straight-line seals on the secantial contour portions of the hoods sweep the upper and lower sides of the heat exchanger stack 1.

In operation, the flue gas flows upwardly through the flue duct into the lower throat portion 3, where the lower rotary hood 6 divides the flue gas stream into two partial streams which enter the heat exchanger stack 1 in those surface portions of the latter which are left exposed by the lower rotary hood 6. The same surface portions of the heat exchanger stack 1 are also exposed on the upper side of the latter, as can be seen in FIG. 2, so that the two partial streams of flue gas which exit upwardly from the heat exchanger reunite above the upper rotary hood 7. As the hot flue gasses flow through the exposed sectors of the heat exchanger stack 1, they transfer heat to these stack sectors.

A downwardly flowing stream of air, entering the upper rotary hood 7 through its air duct connecting portion 9, is likewise divided into two partial air streams which flow through those sector-shaped portions of the heat exchanger stack 1 which are covered by the two rotary hoods 6 and 7. The exiting partial air streams reunite in the lower rotary rotary hood 6, prior to reentering the air duct through the lower connecting portion 8. The air which thus flows through two sectors of the heat exchanger stack 1 is thereby preheated, as it removes heat from the heat exchanger stack 1.

As the lower and upper rotary hoods 7 sweep over the axial faces of the heat exchanger stack 1, those sectors of the latter which have previously been exposed to the hot flue gas will be progressively covered by the two hoods 6 and 7 which close them to the flue gas and open them to the incoming cold air, while those stack sectors which had previously been cooled through exposure to the incoming air are progressively closed to the latter and exposed to the flue gas for reheating. The shape of the lower and upper rotary hoods 6 and 7 is preferably such that they cover approximately one-half of the axial surface areas of the heat exchanger stack 1. The rotation of the hoods thus creates a wave-like heating and cooling action on the entire heat exchanger stack 1, as every portion of the stack is twice alternatingly heated and recooled during each hood revolution. This means that the heat exchanger stack is subjected to a continuously alternating heat load.

As can be seen in FIG. 1, the heat exchanger stack 1 consists of several axially adjacent annular stack layers 11. FIG. 2 shows that each stack layer 11 is, in turn, constituted by a large number of radially and peripherally adjoining heater lamellae packages 12. Two typical heater lamellae packages 12 are shown, at an enlarged scale, in FIG. 3 and FIG. 4. In FIG. 3 is shown a typical prior art heater lamellae package 12 which consists essentially of alternatingly flat and undulating panels of sheet metal held together by means of two pairs of flat-iron mounting brackets 13 and two pairs of vertical tie rods 13*c*. The mounting brackets 13 thereby create a comparatively large axial gap between adjacent layers 11 of the heat exchanger stack 1.

In contrast to the prior art solution of FIG. 3, the present invention suggests to replace the flat-iron mounting brackets 13 with novel guide screen panels 14, as illustrated in FIG. 4. The honeycomb-type panels 14 have the structure of a grate, consisting of a series of perpendicularly intersecting sheet metal strips 14*a*. Each heater lamellae package 12 has a matching guide screen panel 14 on its upper and lower side, the two panels being connected together by means of two pairs of vertical tie rods 16 which perform substantially the same function as the tie rods 13*a* of the prior art structure.

The guide screen panels 14 thus completely close the axial gaps between the stack layers 11. By thus guiding the flows of flue gas and air between axially adjacent stack layers 11, the panels 14 prevent the creation of turbulence and energy loss in this space, while also inhibiting any transverse exchange flow from one gas stream to the other, across the moving line of separation between the stack sectors which are exposed to the flue gas stream and the stack sectors which are exposed to the air stream. The result is not only a better separation between the four flow sectors in the heat exchanger stack, but also a reduction in the overall flow resistance of the heat exchanger stack to the flue gas and to the air, as well as to the blow jets of the soot blowing device.

It should be understood, of course, that the foregoing disclosure describes only a preferred embodiment of the invention and that it is intended to cover all changes and modifications of this example of the invention which fall within the scope of the appended claims.

I claim the following:

1. In a regenerative gas-to-gas heat exchanger which is useable as an air heater, for example, and which has a heat exchanger stack of which at least a portion is alternatingly in contact with a flow of hot gas from which heat is transferred to the heat exchanger and with a flow of cold gas to which said heat is transferred from the heat exchanger, and wherein said flow alternation is controlled by gas flow guide members moving over intake and outlet apertures of the heat exchanger stack; in such a heat exchanger, a heat exchanger stack assembly comprising in combination:

a plurality of stack layers mounted adjacent to each other and having arranged therein a large number of small flow passages which are so oriented that a stream of gas flowing through the heat exchanger successively traverses the stack layers, each stack layer being constituted by a number of adjoining lamellae packages defining said small flow passages between its lamellae; and a pair of guide screen layers arranged on opposite sides of each stack layer in such a way that the gas flowing from one stack layer into another has to traverse the guide screen layers, each guide screen layer being similarly constituted of separate guide screen panels for each lamellae package; and wherein each lamellae package is held together by its associated pair of guide screen panels and by at least one tie rod extending between the two guide screen panels.

2. A heat exchanger stack assembly as defined in claim 1, wherein the guide screen panels have a grate-like structure which is formed by two series of sheet metal strips intersecting each other so as to form quadrangular passages through the guide screen panel.

3. A heat exchanger stack assembly as defined in claim 1, wherein the heat exchanger stack is annular in shape, having cylindrical inner and outer outlines and defining a longitudinal axis;

the stack layers are arranged in a succession of axially adjacent annular layers, each layer occupying a fraction of the total length of the heat exchanger stack;

the lamellae packages which constitute the stack layers have the outline of a truncated sector; and the guide screen panels which constitute the guide screen layers have the same outline as the lamellae packages.

4. A heat exchanger stack assembly as defined in claim 3, wherein each lamellae package comprises a series of alternatingly flat and undulated sheet metal lamellae standing on edge between a pair of said guide screen panels; and the lamellae are held together in said package by means of the guide screen panels and at least two tie rods which connect said panels on opposite sides of the lamellae package in such a way that the lamellae are confined between the tie rods.

* * * * *